US005871004A

United States Patent [19]

Garvison

[11] Patent Number: 5,871,004

[45] Date of Patent: Feb. 16, 1999

[54] ROTATABLE BOWSTRING RETENTION AND RELEASE MECHANISM

[76] Inventor: Geary L. Garvison, 13757 64th St., South Haven, Mich. 49090

[21] Appl. No.: 954,329

[22] Filed: Oct. 17, 1997

[51] Int. Cl.[6] ..... F41B 5/18

[52] U.S. Cl. ..... 124/35.2

[58] Field of Search ..... 124/35.2

[56] References Cited

U.S. PATENT DOCUMENTS

| | | | |
|---|---|---|---|
| 4,485,798 | 12/1984 | Hamm | 124/35.2 |
| 4,509,497 | 4/1985 | Garvison | 124/35.2 |
| 4,527,536 | 7/1985 | Smith | 124/35.2 |
| 4,539,968 | 9/1985 | Garvison | 124/35.2 |
| 4,620,523 | 11/1986 | Peck | 124/35.2 |
| 4,674,469 | 6/1987 | Peck | 124/35.2 |
| 4,691,683 | 9/1987 | Peck | 124/35.2 |
| 4,881,516 | 11/1989 | Peck | 124/35.2 |
| 4,926,835 | 5/1990 | Peck | 124/35.2 |
| 4,981,128 | 1/1991 | Garvison | 124/35.2 |
| 4,982,718 | 1/1991 | Hamm | 124/35.2 |
| 5,027,786 | 7/1991 | Peck | 124/35.2 |
| 5,070,854 | 12/1991 | Peck | 124/35.2 |
| 5,076,251 | 12/1991 | Peck | 124/35.2 |
| 5,078,116 | 1/1992 | Peck | 124/35.2 |
| 5,103,796 | 4/1992 | Peck | 124/35.2 |
| 5,170,771 | 12/1992 | Peck | 124/35.2 |
| 5,170,772 | 12/1992 | Hamm | 124/35.2 |
| 5,263,466 | 11/1993 | Peck | 124/35.2 |
| 5,307,788 | 5/1994 | Peck | 124/35.2 |
| 5,318,004 | 6/1994 | Peck | 124/35.2 |
| 5,357,939 | 10/1994 | Tentler | 124/35.2 |
| 5,359,983 | 11/1994 | Peck | 124/35.2 |
| 5,370,102 | 12/1994 | Peck | 124/35.2 |
| 5,417,197 | 5/1995 | Bankstahl | 124/35.2 |
| 5,558,077 | 9/1996 | Linsmeyer | 124/35.2 |
| 5,564,407 | 10/1996 | Linsmeyer | 124/35.2 |
| 5,582,158 | 12/1996 | Linsmeyer | 124/35.2 |
| 5,618,662 | 4/1997 | Tentler | 124/35.2 |

*Primary Examiner*—John A. Ricci

*Attorney, Agent, or Firm*—The Firm of Gordon W. Hueschen

[57] ABSTRACT

A bowstring retention and release mechanism includes a housing or body with a head rotatable 360° therein and a lower forward projection extending out of the head providing an upward bowstring-engaging surface upon which the bowstring can rest and which, in combination with a downwardly-extending segment of a lever arm, which also extends forwardly outside of the head and which is pivoted within the head, provides for retention and release of the bowstring. The lever arm is biased upwardly for release of the bowstring but is maintained in downward bow-string-retention position by a rearwardly-extending protuberance which cooperates with an activator which is slidably mounted within the head and which is forwardly biased so as to cam the protuberance up an upward incline to a forward step on the activator, thereby preventing the lever arm from upward movement into bowstring-release position. When the trigger is pulled rearwardly, the forward bias is overcome and the activator is pulled rearwardly, permitting the protuberance to leave the step and the lever arm to pivot upwardly into bowstring release position. Upon release of the trigger, the forward bias upon the activator re-exerts itself, forcing the protuberance upwardly along the incline and onto the forward step of the activator, once again locking the downwardly-extending segment of the lever arm into downward and bowstring-retention position. For reinsertion of a bowstring into the mechanism, the trigger is simply pulled rearwardly, causing the lever arm to assume bowstring-release position for insertion of the bowstring and then released, causing the forward bias to reassert itself and the lever arm to assume downward and bowstring retention position.

20 Claims, 6 Drawing Sheets

Fig. 4
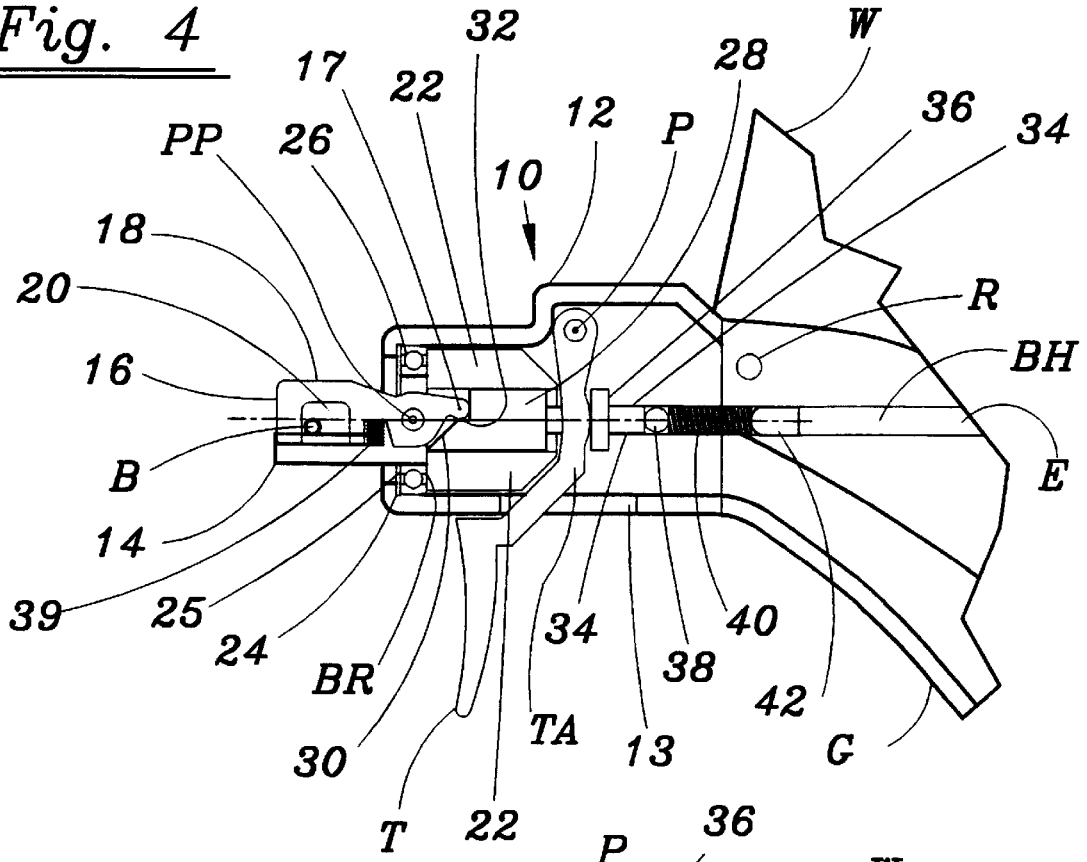
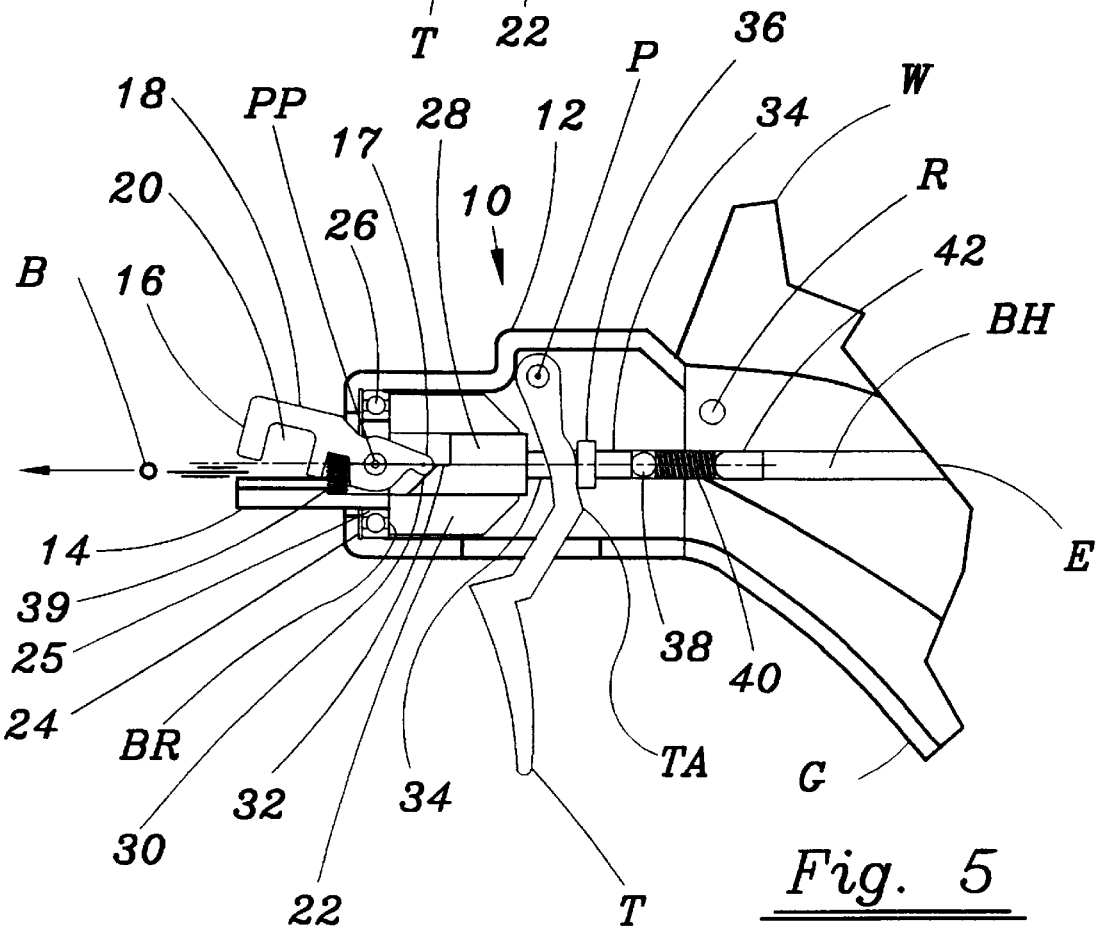
Fig. 5

Fig. 8
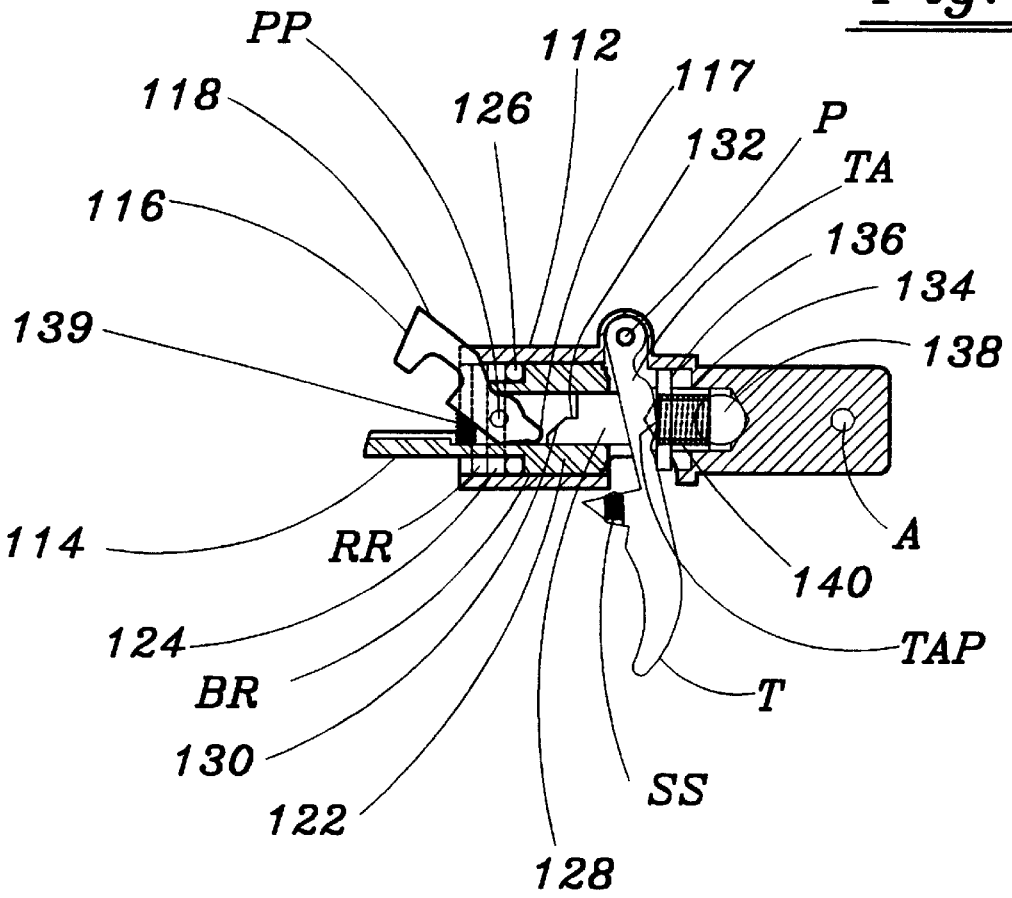
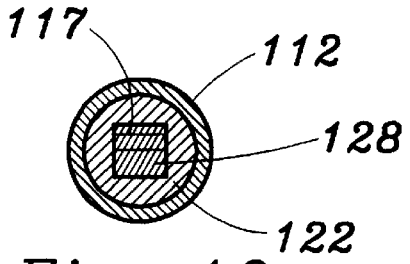
Fig. 10
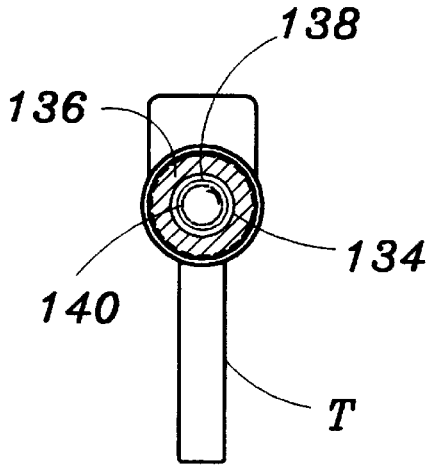
Fig. 12
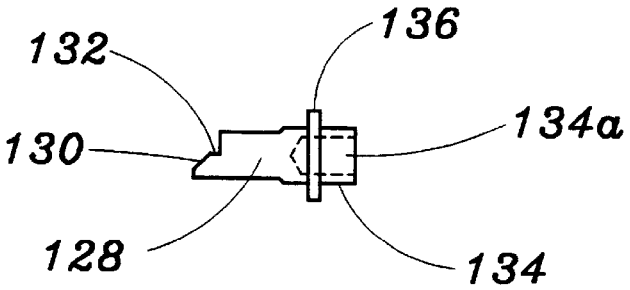
Fig. 11

ROTATABLE BOWSTRING RETENTION AND RELEASE MECHANISM

BACKGROUND OF THE INVENTION

1. Field of the Invention

The present invention relates to bowstring retention and release mechanisms of the type having releasable means for retaining a bowstring, said means having a bowstring retention position and a bowstring release position, the said means being held in bowstring-retention position by means which is released by activation of a trigger.

2. Description of the Prior Art

Innumerable bowstring retention and release mechanisms are now available in the art and numerous of the same have been patented. Such devices are now commonly used for target shooting as well as for hunting and their popularity is growing. Such devices already available permit adjustment of the relative angular relationship between the grip of the mechanism and the bowstring by virtue of rotatability of the inner core of the device with relation to the outer core of the device which is attached to the grip. The numerous prior-art patents on devices of such type turned up by a recent search are listed upon the enclosed PTO-1449 and copies thereof are provided herewith. A study of those 29 patents shows that none of them discloses or suggests the simplified but efficient mechanism of the present invention.

OBJECTS OF THE PRESENT INVENTION

An object of the present invention is to provide an improved bowstring retention and release mechanism which provides uniform retention and release of the bowstring, thereby increasing accuracy, and which provides the necessary or desirable angularly adjustable relationship of the grip relative to the bowstring by virtue of a rotatable design which overall is simpler, less expensive, uncomplicated, and totally foolproof when compared with similar devices available from the prior art.

Additional objects will become apparent hereinafter and still others will be apparent to one skilled in the art to which this invention pertains.

THE PRESENT INVENTION

The bowstring retention and release device of the present invention is remarkably and unobviously simple, efficient, and foolproof when compared with devices of a similar nature provided by the prior art and which are already on the market. As a result of its improved design, it avoids problems arising from complexity during operation and requires little or absolutely no maintenance.

The bowstring retention and release mechanism of the invention includes a housing or body with a head rotatable 360° with relation to the body and a lower forward projection extending out of said head providing a bowstring-engaging surface upon which the bowstring can rest and which, in combination with an abutting downwardly-extending segment of a lever arm, which also extends forwardly outside of said head and which is pivoted within said head, provides the means for retention and release of the bowstring. The lever arm is biased upwardly for release of the bowstring from bowstring-retention position into upward bowstring-release position. The lever arm and its downwardly-extending segment are maintained in downward bowstring-retention position by means of a rearwardly-extending protuberance on said lever arm which cooperates with an activator which is slidably mounted within said head and which is forwardly biased so as to cam or force said protuberance by means of a forward upwardly-extending incline to a forwardly-located step on said activator, thereby preventing said lever arm from upward movement into bowstring-release position. When the trigger arm is pulled rearwardly, the forward bias is overcome and the activator is pulled rearwardly, permitting said lever arm rear protuberance to leave said step and the lever arm and its downwardly-extending segment to pivot upwardly into bowstring release position. Upon release of the trigger, the forward bias upon the activator re-exerts itself, forcing the protuberance upwardly along said incline and onto the forward step of the activator, once again locking the downwardly-extending segment of said lever arm into downward and bowstring-retention position abutting upon the bowstring-engaging surface of said underlying forward projection. For reinsertion of the bowstring into the mechanism, the trigger is simply pulled rearwardly, thus causing the lever arm to assume bowstring-release position for insertion of the bowstring and then released, causing the forward bias to reassert itself and the lever arm and its downwardly-extending segment to assume downward and bowstring retention position abutting upon the bowstring-engaging surface of said underlying forward projection.

The advantages and features of the invention will be more readily understood by reference to the drawings and detailed description which follow.

SUMMARY OF THE INVENTION

The invention, then, comprises the following, inter alia, either singly or in combination:

A bowstring retention and release mechanism, when viewed in bowstring-horizontal position and the bowstring-engaging surface thereof in upward position, comprising:

a hollow housing or body, a head rotatably mounted in said body, said head comprising a forward projection extending forwardly outside of said body, said forward projection comprising an upward bowstring-engaging surface for positioning of a drawn bowstring thereon, said head also comprising a lever arm mounted therein and extending forwardly outside of said body and pivoted about a pivot point in said head and having forward and rearward portions on opposite sides of said pivot point, and having downward bowstring-retention and upward bowstring-release positions, said forward lever arm portion comprising a downwardly-extending segment cooperating with said upward bowstring-engaging surface on said forward projection to retain a bowstring behind said segment and on said surface when said lever arm is in downward bowstring-retention position, and to release said bowstring therefrom when said lever arm is in upward bowstring-release position, said lever arm being biased upwardly into bowstring release position, said rearward lever arm portion having a rearwardly-extending protuberance thereon, activator means having forward and rearward positions mounted in said head in slidable engagement therewith and comprising a forward portion, comprising an upwardly-located step and an incline leading to said step for engagement of said lever arm rear protuberance by said incline for camming it upwardly to rest upon said step when said activator is in activator forward position, and a rear portion comprising a rearwardly-extending activator extension, said activator extension having contact means thereon for engagement with cooperating contact means on a trigger arm and said activator extension and consequently said activator itself being biased forwardly by biasing means for maintaining said lever arm rear protuberance on said step at said activator forward portion, a trigger arm pivotally mounted in said body toward the top thereof comprising contact means adapted to engage said contact means on said activator extension forwardly thereof, whereby said head and its forward projection and lever arm and said activator are freely rotatable in said body so as to retain a bowstring behind said downwardly-extending segment of said lever arm and on said upward bowstring-engaging surface of said forward projection regardless of the angle at which the bow is held, and whereby, when said trigger arm is pulled rearwardly, said activator extension and said activator are pulled rearwardly overcoming said forward bias, said lever arm rearwardly-extending protuberance becomes disengaged from said step on said activator, and said lever arm is thus permitted to pivot downwardly at its rearward end and the downwardly extending segment at the lever arm forward end is permitted to pivot upwardly, thereby releasing said bowstring from said upward bowstring-engaging surface of the forward projection of said head; such a mechanism wherein, upon release of said trigger, the forward bias forces the activator extension and the activator itself forwardly and the incline at the forward portion of the activator cams the lever arm rear protuberance upwardly upon said step for closing said downwardly extending segment of said lever arm upon said forward extension upward bowstring-engaging surface; such a mechanism wherein the forward bias upon said activator extension is provided by a coil spring; such a mechanism wherein the upward bias upon the lever arm is provided by a coil spring; such a mechanism wherein the contact means on said activator extension comprises an enlargement thereof or protuberance thereon; such a mechanism wherein the contact means on said activator extension comprises a ring or washer; such a mechanism wherein the trigger arm is arranged to permit said activator extension to move freely with respect thereto but is adapted to engage the contact means thereon; such a mechanism wherein the contact means on said trigger arm includes a bifurcation of said trigger arm to provide an aperture therein which surrounds said activator extension and is adapted to engage the contact means on said activator extension; such a mechanism wherein said forward projection is elongated and generally U-shaped in cross-section; such a mechanism wherein said forward projection is generally U-shaped in cross-section and wherein said U has a flat bottom; such a mechanism wherein said downwardly-extending segment of said lever arm in downward bowstring-retention position rests within or between the upturned edges of said U-shaped forward projection; such a mechanism wherein said downwardly-extending segment of said lever arm in downward bowstring-retention position rests within or between the upturned edges of the said flat-bottomed U; such a mechanism wherein said activator extension extends rearwardly outside of said head; such a mechanism mounted to a hand wrap or handle; such a mechanism wherein said activator, activator extension, and the contact means on said activator extension are integral; such a mechanism wherein said activator extension has a rearward cavity for receipt of spring-biasing means therein; such a mechanism wherein said trigger arm is integral with a trigger comprising a set screw for adjusting the distance between the housing and the trigger and thus the length of the trigger pull; such a mechanism wherein the forward biasing means comprises a coil spring and a ball bearing; such a mechanism wherein the forward biasing means comprises a coil spring and a ball bearing and wherein said spring is located in a cavity in said activator extension; and finally such a mechanism wherein said activator has a cross-sectionally rectangular forward end which fits into a corresponding aperture in said head.

DESCRIPTION OF THE DRAWINGS

In the drawings and description, the bowstring retention and release mechanism is depicted and described as viewed in bowstring-horizontal position and the bowstring-engaging surface thereof in upward position.

FIG. 4 is an enlarged cross-sectional view of the mechanism of FIG. 1 taken along the line 4—4 of FIG. 1 with the head rotated into coplanar alignment with the grip and the body or housing and with the mechanism in bowstring-retention position.

FIG. 5 is the same as FIG. 4, but showing the mechanism in bowstring-release or bowstring-reloading position after the trigger has been pulled.

FIG. 8 is the same as FIG. 7 showing the mechanism in bowstring-release or bowstring-reloading position.

FIG. 10 is a cross sectional view taken along the line 10—10 of FIG. 7.

FIG. 11 is a side elevational view, partially in section, of an integral activator, activator extension, and trigger-arm contacting protuberance having a cavity therein for receipt of a coil spring or other spring-biasing means therein.

FIG. 12 is an enlarged cross sectional view of the mechanism taken along line 12—12 of FIG. 7.

DESCRIPTION OF THE PREFERRED EMBODIMENTS

Figure 1:
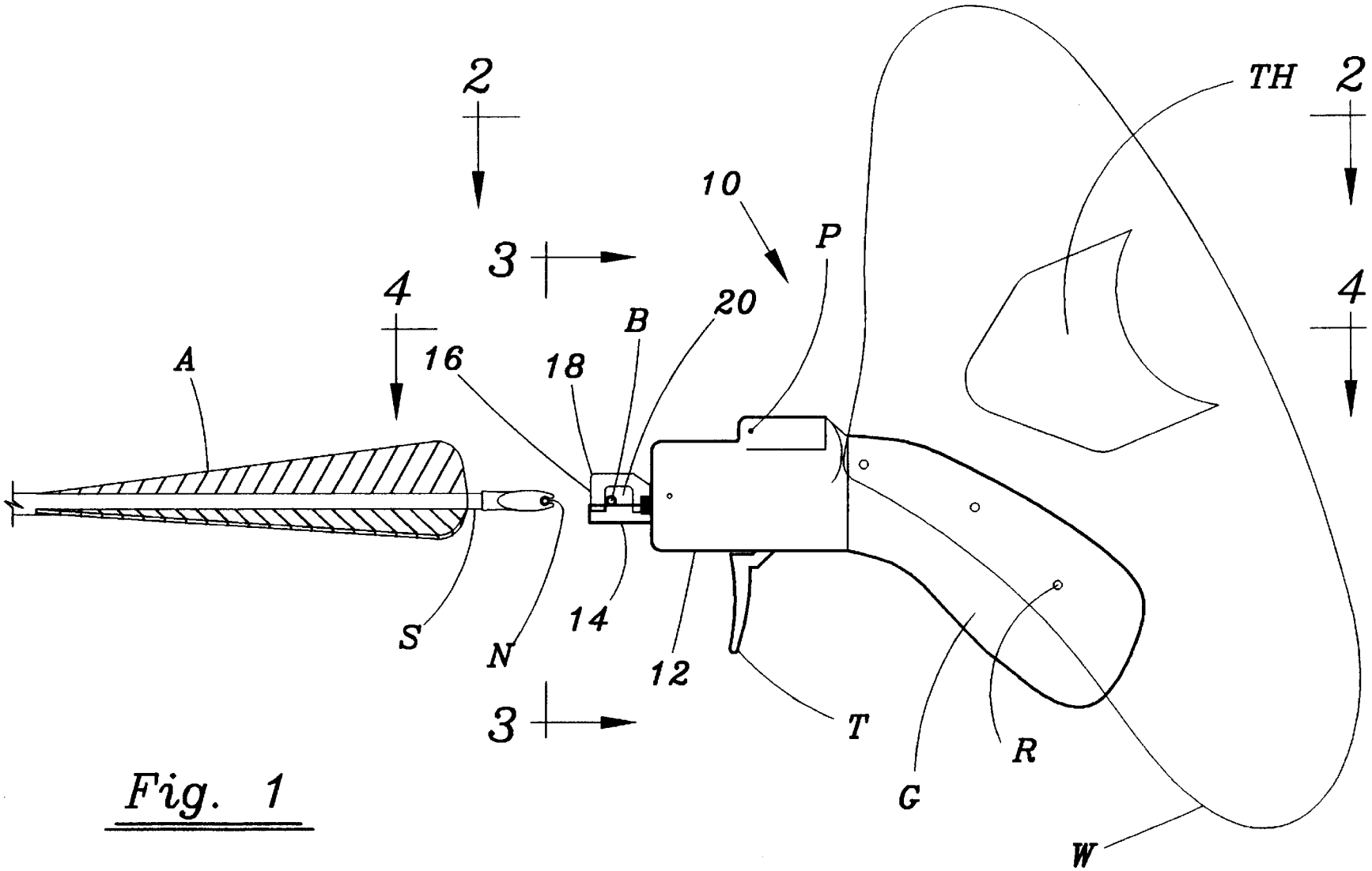
FIG. 1 is an enlarged side elevational illustration of a fully-assembled bowstring retention and release mechanism of the present invention attached to a handle or grip which is in turn attached to a usual-type wrap with thumb aperture for better gripping thereof, showing the bowstring in place and the nock of the arrow about to be engaged with the bowstring whereafter, upon tensioning of the bowstring by forward movement of the bow, the bowstring will be ready for release by pulling upon the trigger.

Reference is now made to the drawings for a better understanding of the invention, in which, as shown in FIG. 1, the bowstring retention and release mechanism of the present invention is shown generally at 10 including grip or handle G, usually of wood or plastic, to which is attached wrap-around hand grasp W secured to grip or handle G by one or more rivets R and comprising thumbhole TH and which may also comprise a strap and buckle as is conventional in the art.

Toward the forward end of grip or handle G is located housing or body 12 comprising pivot P which serves as pivot for trigger T and integral trigger arm TA.

Protruding outwardly from body 12 is forward projection 14 upon the upward surface of which rest the bowstring B and downward segment 16 of lever arm 18 when said lever arm 18 is in bowstring-retention position. This surface of forward projection 14 is often referred to herein as the "bowstring engaging" surface. Shown within the aperture 20 formed by downward segment 16 of lever arm 18 and forward projection 14, both extending outwardly out of body 12 from head 22 (not shown in FIG. 1), is bowstring B.

To the left of the bowstring retention and release mechanism is shown arrow A with shaft S comprising nock N about to be engaged with bowstring B by the bowman.

Figure 2:
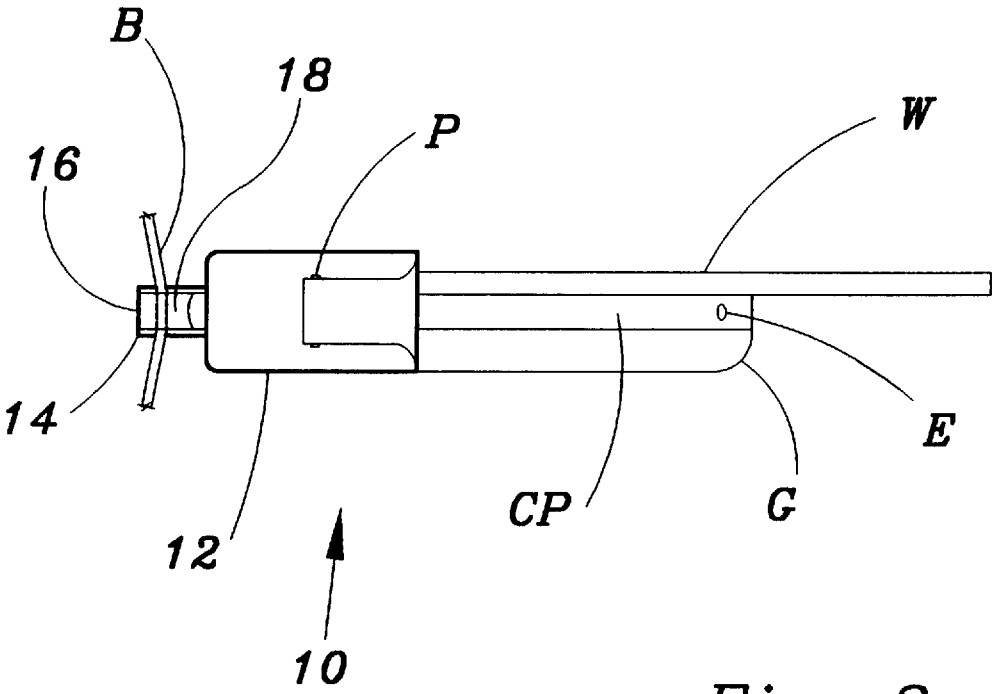
FIG. 2 is an enlarged top view of the bowstring retention and release mechanism of FIG. 1 taken along line 2—2 of FIG. 1.

In FIG. 2 is shown a top view of the device of FIG. 1, including the bowstring B retained in bowstring-retention position by downward segment 16 of lever arm 18 impinging upon the upward surface of forward projection 14 situated directly therebelow, both extending out of head 22 inside of body 12 with pivot P serving internally as the pivot for trigger arm TA inside of body 12. Thumb, hand, or wrist wrap W is also shown, as well as grip or handle G, having a central portion CP of metal or plastic, preferably of a metal such as aluminum, with a borehole BH (FIGS. 4 and 5) therein, the entrance to the borehole BH being shown at E.

Figure 3:
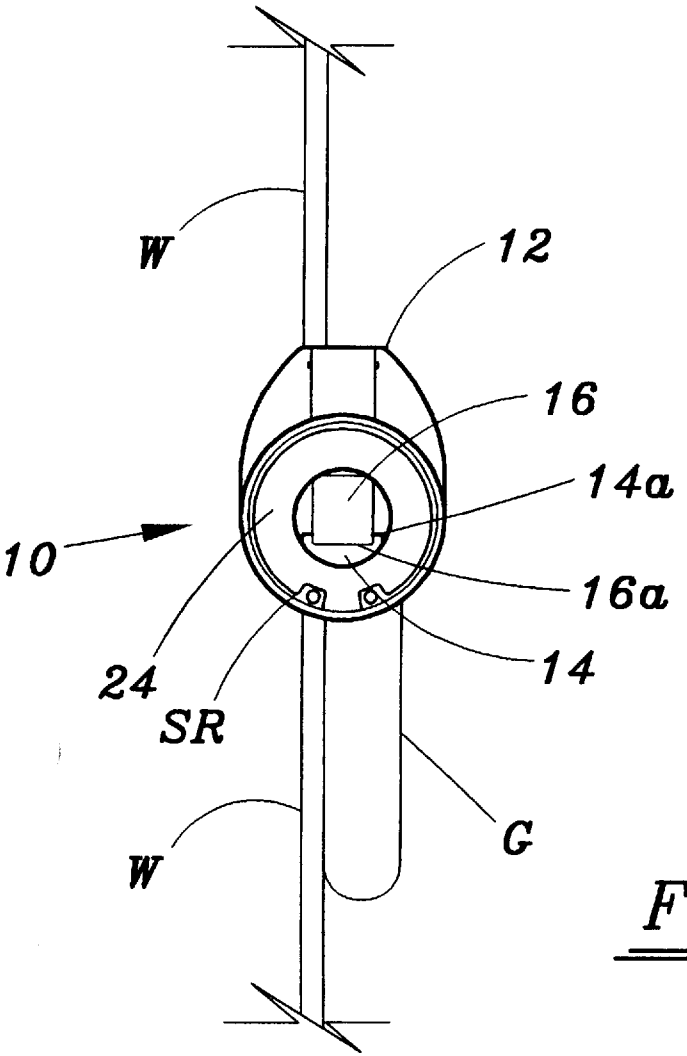
FIG. 3 is an enlarged front view of the bowstring retention and release mechanism of FIG. 1 taken along line 3—3 of FIG. 1.

FIG. 3 is a front view of the mechanism of the invention, once again showing thumb, hand, or wrist wrap W, grip or handle G, housing or body 12, forward projection 14 and downward segment 16 of lever arm 18 snugly fitting within sidewalls 14*a* of the upward surface of forward projection 14. Also shown is bearing retention plate 24, secured to body 12 by snapring or retaining ring SR, for retaining bearings 26 within body 12 to permit 360° of rotation of head 22 within body 12, all as will be described hereinafter.

As seen in this FIG. 3, the forward projection 14 is longitudinally generally U-shaped in cross section, and preferably said U has a flat bottom and the downwardly-extending segment 16 of said lever arm 18 in downward bowstring-retention position rests within or between the upturned edges or sidewalls 14*a* of said U-shaped forward projection 14, and preferably has a flat lower edge 16*a* which rests within or between the upturned edges 14*a* of the said flat-bottom U.

Referring now to FIG. 4, body or housing 12 is shown with head 22 rotatably mounted interior thereof by means of bearings 26 and retaining clips 25, all within bearing race BR with bearing retention plate 24 holding the bearing assembly in place in bearing race BR at the forward end of body 12 so that head 22 is rotatable 360° with respect to body 12. Slidably mounted interior of head 22 is activator 28, comprising forward upwardly extending incline 30 leading to step 32, both at the forward edge of activator 28. At the rear of activator 28 is activator extension 34, having trigger arm TA contact means in the form of protuberance, in the form of ring or washer 36, affixed thereto or as an integral part thereof. Ahead of said washer or protuberance 36 is trigger arm TA, pivoted within body 12 at pivot P. Trigger arm TA as shown is bifurcated at a portion thereof so as to surround activator extension 34 ahead of contact means in the form of protuberance 36. Mounted in borehole BH in handle or grip G behind the rearward extremity of activator extension 34 is ball bearing 38 biased forwardly as by coil spring or highly-resilient elastomer 40, in turn secured in borehole BH by means of plug 42 press-fit or screwed securely into borehole BH, thus providing a forward bias to activator extension 34, contact means in the form of protuberance 36 thereon, and thus also to trigger arm TA and to activator 28 itself. As seen in this FIG. 4, the contact means on said activator extension 34 for engagement with the trigger arm TA comprises an enlargement of the activator extension 34 in the form of a protuberance thereon, as shown advantageously in the form of an attached or integral ring or washer 36, and the contact means on the trigger arm TA is adapted to engage contact means 36 on the activator extension 34 and thus is in the form of an offset, and preferably a bifurcation thereof to provide an aperture therein, which is at least on one side of and which preferably surrounds said activator extension 34, permitting it to move freely with respect thereto, but which is in any case adapted to engage the contact means 36 thereon.

Mounted ahead of activator 28 in head 22 on pivot PP is lever arm 18 having a rearwardly-extending protuberance 17. Forwardly of said lever arm 18 is downward segment 16 nesting securely upon the upward and bowstring-engaging surface of forward projection 14 so as to provide aperture 20 within which bowstring B resides when the device is in bowstring-retention position. In bowstring-retention position, downward segment 16 of lever arm 18 is in downward position, but it is biased upwardly as by coil spring or highly-resilient elastomer 39 acting upon lever arm 18 and located between forward projection 14 and lever arm 18 ahead of pivot PP, preferably at least partly in an aperture in lever arm 18. Lever arm 18 has forward and rearward portions on opposite sides of said pivot P and, in normal bowstring-retention position, protuberance 17 at the rear of lever arm 18 rests upon step 32 of activator 28 and is retained there by the forward bias provided by means of coil spring 40 or the like acting upon ball bearing 38 and activator extension 34 as well as contact means in the form of protuberance 36 thereon.

At the bottom of housing or body 12 is opening 13 behind trigger arm TA, enabling trigger T and integral trigger arm TA to be pulled rearwardly about its pivot P within body 12, thereby to exert rearward pressure upon trigger arm contact means, e.g., protuberance 36 on activator extension 34, and thereby to offset the forward bias provided by coil spring 40 or the like.

When trigger T is pulled rearwardly, as shown in FIG. 5, offsetting the said forward bias, and pulling activator extension 34 and attached activator 28 rearwardly, lever arm rear projection 17 slips off of step 32 at the forward edge of activator 28, which no longer restrains downward movement of projection 17, and upward bias by means of coil spring 39 or the like comes into play, tilting lever arm 18 including downward segment 16 upwardly, thereby releasing bowstring B from aperture 20 formed by the bowstring-engaging surface of forward projection 14 and lever arm downward segment 16.

Upon release of trigger T, forward bias of activator 28 returns to play, thereby engaging rear protuberance 17 of lever arm 18 by upward incline 30 at the lower portion of activator 28, thus camming said rear protuberance 17 back into position on step 32 at the forward edge of activator 28 and overcoming the upward bias provided to lever arm 18 by coil spring 39 or the like, thus returning downward segment 16 of lever arm 18 back into engagement with the surface of forward protuberance 14 and restoring the aperture 20 formed therebetween.

For reloading of a bowstring B into said aperture 20, it is only necessary to hold trigger T backwardly for a short time, slip bowstring B into aperture 20, and then release trigger T, thereupon returning the device to bowstring-retention condition or position, as opposed to its bowstring-release position or condition assumed upon pulling trigger T rearwardly as shown in FIG. 5.

The upwardly-sloping incline 30 at the front of the activator 28 is provided for camming or forcing the protuberance 17 at the rear of lever arm 18 upwardly and upon the step 32 at the forward portion of the activator 28 once the trigger T is released after once having been pulled.

Thus, upon release of the trigger T, the forward bias afforded to the activator 28 by spring 40 acting upon activator extension 34 results in the activator 28 itself being forced forwardly, the incline 30 thereupon engaging protuberance 17 at the rear of lever arm 18, thereby forcing said protuberance 17 upwardly and upon step 32 at the forward portion of activator 28, thereby returning downwardly-extending segment 16 of lever arm 18 to the bowstring-retention position. Of course, to release the downwardly-extending segment 16 from bowstring-retention position, so that a bowstring can again be restrained thereby, it is only necessary to pull trigger T backwardly sufficiently so as once again to release the forward bias upon the activator extension 34 and activator 28, so that the upward bias afforded by spring 39 upon forwardly-extending lever arm 18 can again exert itself, thereby lifting lever arm 18 and its downwardly-extending segment 16, opening the device once again to bowstring-loading position, whereupon trigger T may once again be released, all elements then operating in reverse and securing the bowstring by means of downwardly-extending segment 16 upon the bowstring-engaging surface of the cooperating forward projection 14 in bowstring-ready or cocked position.

As far as the resistance to trigger pull and the strength or rapidity of upward movement of lever arm 18 and its downward segment 16, these are relatively simply adjusted by selection of the coil spring or other biasing means 40 and 39, as will be apparent to one skilled in the art.

Figure 6:
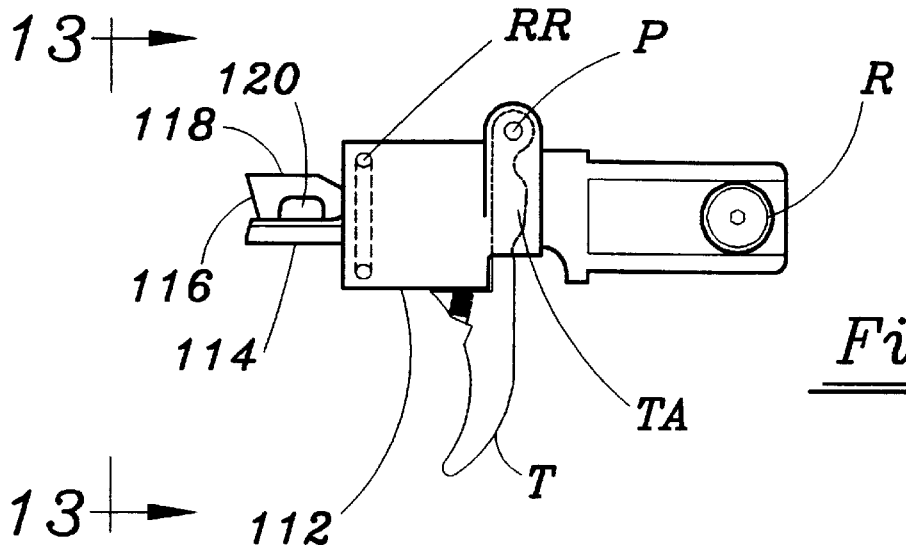
FIG. 6 is an enlarged side elevational view of another embodiment of the invention.

Referring now to FIG. 6, which is a side view of an alternative embodiment of the invention, the body or housing being partially in section to identify the retention rods for the bearing retention plate and the trigger arm, the usual elements are shown, including housing 112, pivot P, trigger T, lower forward extension 114, and forward lever arm 118 and its downward segment 116. Bearing retention plate 124 (not shown) is retained in housing 112 by retention rods RR as more fully shown in FIG. 13. The mechanism will be secured to a usual wrist wrap by means of rivet or screw into a clip C as shown in FIG. 9 or into a threaded aperture A in the housing (FIG. 7 or 8).

Figure 7:
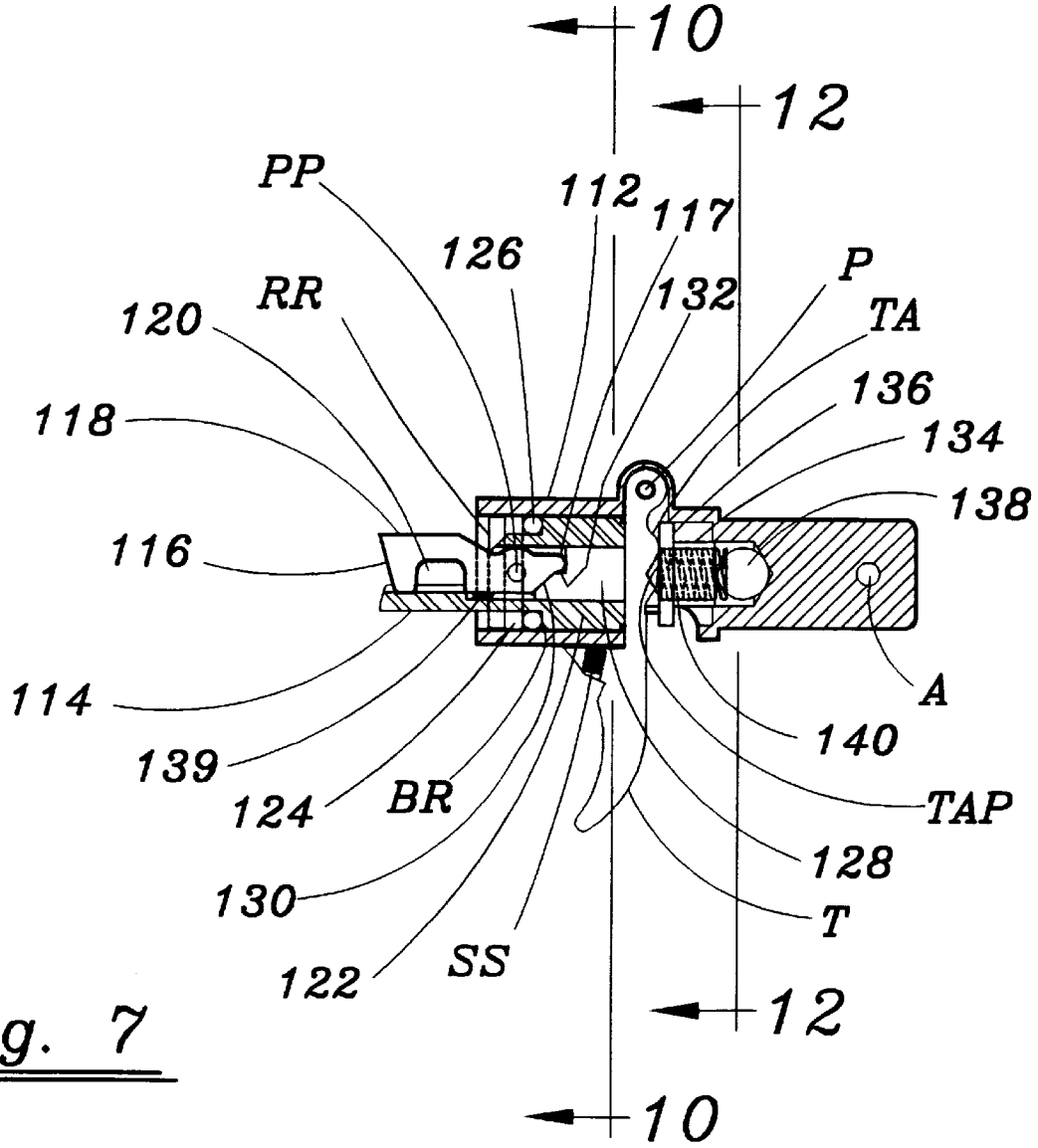
FIG. 7 is like FIG. 4 and is an enlarged cross sectional view of the alternate mechanism of the invention shown in FIG. 6 with one side cut away to show the mechanism in bowstring-retention position.
Figures 9, 13:
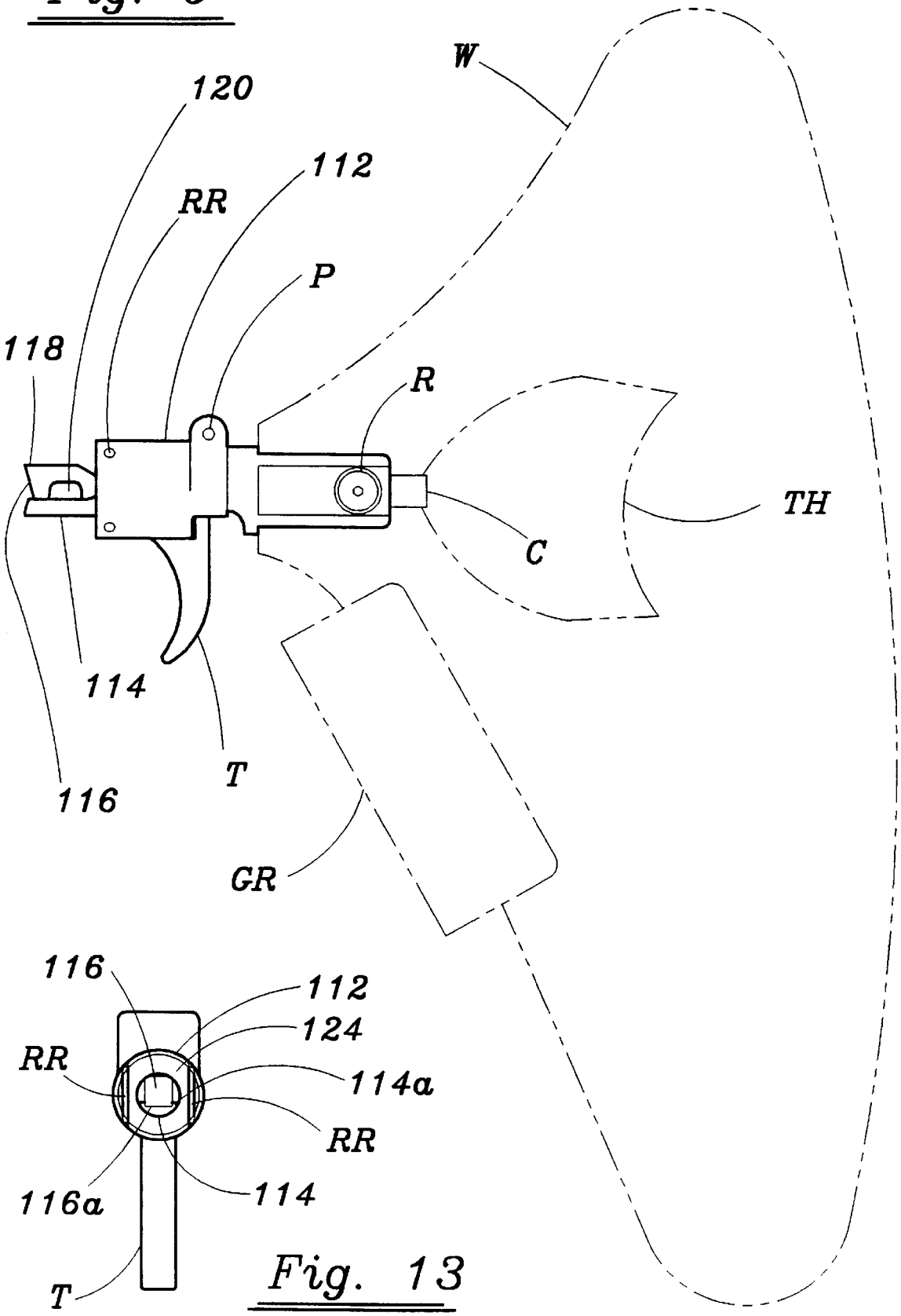
FIG. 9 is like FIG. 6 showing the mechanism attached to a wrist strap with thumb aperture and grip.
FIG. 13 is a front view of the alternate embodiment of the invention taken along line 13—13 of FIG. 6.

From the cross-sectional view of FIG. 7, a rear segment of the body or housing 112 may be tapped to provide aperture A for securement to a usual wrist wrap W as shown in FIG. 9 by means of a rivet or screw R. Housing 112 encloses fully rotatable head 122 made rotatable by means of bearings 126 enclosed in a bearing race including bearings 126 and bearing retention plate 124 secured in housing 112 by means of retention rods RR. Lever arm 118 is pivoted about pivot point P and includes downwardly-extending segment 116 which nests securely upon the bowstring-engaging surface of forward extension 114. At the rear of lever arm 112 is protuberance 117 which rests upon step 132 of activator 128 in normal bowstring-retention position, activator 128 having an upwardly-inclined slope 130 forwardly ahead of step 132. In this position coil spring or the like 139 is compressed. Trigger T is shown comprising a set screw SS for adjustment of the length of the trigger pull and trigger arm TA is shown as having trigger arm protuberance TAP for better contact with protuberance 136 on activator extension 134 which in this case is, along with protuberance 136, integral with activator 128. Activator extension 134 is shown as having a reamed out circular cavity, designated 134*a* in FIG. 11, for receiving coil spring or the like 140 and a portion of ball bearing 138, the activator extension 134 and its contained spring-biasing means 140 and ball bearing 138 being received in a suitable corresponding cavity provided in housing 112 at the rearward portion thereof.

In FIG. 8 the same elements are shown, but the mechanism is now in the bowstring-release or bowstring-reloading position with the trigger T pulled rearwardly, thereby forcing trigger arm protuberance TAP on trigger arm TA to engage contact means 136 on activator extension 134, thereby compressing spring-biasing means 140 against ball bearing 138 within the cavity formed for these elements within housing 112. With the spring bias provided by coil spring 140 or other spring-biasing means thus offset, activator 128 moves rearwardly, thereby permitting protuberance 117 to slide off step 132 and down incline 130, as lever arm 118 and downward extension 116 thereof are urged upwardly by spring biasing means 139, thereby opening aperture 120 and releasing the bowstring, just as shown in FIG. 5.

FIG. 9 shows the device of FIG. 6 attached to a usual wrap W having thumbhole TH and grip GR attached to housing 112 at the rear thereof by means of clip C surrounding a portion of the forward edge of the wrap W and secured thereto by means of rivet or screw R which is received and/or anchored in the opposite arm of clip C or in aperture A.

The view of FIG. 10 looks forward into head 122 mounted inside of housing 112 and shows rear protuberance 117 of lever arm 118 through the rectangular aperture provided in head 122 for receiving the rectangular forward portion of activator 128.

FIG. 11 shows the integral activator, activator extension, and trigger arm contact means 136 in the form of a ring, all being integral, with the rear end of activator extension 134 being bored out to provide cylindrical cavity or chamber 134*a* for receipt of spring biasing means 140 as shown in FIGS. 7 and 8. The forward end of activator 128 comprising step 132 and incline 130 is rectangular in cross section so as to fit into the rectangular opening shown in head 122 in FIG. 10.

FIG. 12 is a cross-sectional view taken along the line 12—12 of FIG. 7 and shows ball bearing 138 resting upon spring biasing means 140 within the cavity 134*a* at the rear of activator extension 134 as well as the trigger arm contact means in the form of integral ring or washer 136 as shown in FIG. 11.

FIG. 13 is a front view of the mechanism as shown in FIG. 6, showing housing 112 and trigger T, with upturned edges 114*a* of forward extension 114 nesting flat lower edge 116*a* of downward segment 116 of lever arm 118 therebetween and firmly in contact with the upward bowstring-engaging surface thereof, whereas bearing retention plate or ring 124 is retained in position by means of retention rods RR press-fit at their tops and bottoms into cooperating apertures in housing 112.

As will be apparent, the alternative embodiment operates in the same manner as the embodiment first described and shown in the drawings, operating in the same manner but being somewhat more compact and efficient, and having a unique integral activator, activator extension, and trigger arm contact means or protuberance on the activator extension, and also having a set screw SS for adjustment of the trigger stroke.

As further embodiments of the invention which will immediately be apparent to one skilled in the art upon reading this Specification, the protuberance 17 or 117 at the rear of lever 18 or 118 may if desired embody or incorporate roller means, for example, a small roller bearing, or other similar rotatable element, which would not interfere with but which would facilitate its travel up and down incline 30 or 130 and up on step 32 or 132, and all opposed contacting or sliding surfaces, such as protuberance 17 or 117 and incline 30 or 130 as well as head 22 or 122 and activator 28 or 128 and activator extension 34 or 134 and trigger arm TA, may be coated for better slidability with a surface coating of Teflon® or the like, whereas "grabbing" contact surfaces of trigger arm TA and activator extension protuberance 36, 136 would normally not be so coated. Other usual and/or advantageous equivalents will of course also be apparent to one skilled in the art to which this invention pertains.

Accordingly, from the foregoing, it is seen that a new and improved and foolproof rotatable bowstring retention and release mechanism, utilizing a simple and inexpensive design not previously available, has been provided, and whereby all of the other advantages and objectives of the present invention have been attained.

It is to be understood that the present invention is not to be limited to the exact details of operation, or to the exact materials, procedures, or embodiments shown and described, as various modifications and equivalents will be apparent to one skilled in the art, wherefore the present invention is to be limited only by the full scope which can be legally accorded to the appended claims.

I claim:

1. A bowstring retention and release mechanism, when viewed in bowstring-horizontal position and the bowstring-engaging surface thereof in upward position, comprising:

a hollow housing or body, a head rotatably mounted in said body, said head comprising a forward projection extending forwardly outside of said body, said forward projection comprising an upward bowstring-engaging surface for positioning of a drawn bowstring thereon, said head also comprising a lever arm mounted therein and extending forwardly outside of said body and pivoted about a pivot point in said head and having forward and rearward portions on opposite sides of said pivot point, and having downward bowstring-retention and upward bow-string-release positions, said forward lever arm portion comprising a downwardly-extending segment cooperating with said upward bowstring-engaging surface on said forward projection to retain a bowstring behind said segment and on said surface when said lever arm is in downward bowstring-retention position, and to release said bowstring therefrom when said lever arm is in upward bowstring-release position, said lever arm being biased upwardly into bowstring release position, said rearward lever arm portion having a rearwardly-extending protuberance thereon, activator means having forward and rearward positions mounted in said head in slidable engagement therewith and comprising a forward portion, comprising an upwardly-located step and an incline leading to said step for engagement of said lever arm rear protuberance by said incline for camming it upwardly to rest upon said step when said activator is in activator forward position, and a rear portion comprising a rearwardly-extending activator extension, said activator extension having contact means thereon for engagement with cooperating contact means on a trigger arm and said activator extension and consequently said activator itself being biased forwardly by biasing means for maintaining said lever arm rear protuberance on said step at said activator forward portion, a trigger arm pivotally mounted in said body toward the top thereof comprising contact means adapted to engage said contact means on said activator extension forwardly thereof, whereby said head and its forward projection and lever arm and said activator are freely rotatable in said body so as to retain a bowstring behind said downwardly-extending segment of said lever arm and on said upward bowstring-engaging surface of said forward projection regardless of the angle at which the bow is held, and whereby, when said trigger arm is pulled rearwardly, said activator extension and said activator are pulled rearwardly overcoming said forward bias, said lever arm rearwardly-extending protuberance becomes disengaged from said step on said activator, and said lever arm is thus permitted to pivot downwardly at its rearward end and the downwardly extending segment at the lever arm forward end is permitted to pivot upwardly, thereby releasing said bowstring from said upward bowstring-engaging surface of the forward projection of said head.

2. The mechanism of claim 1 wherein, upon release of said trigger, the forward bias forces the activator extension and the activator itself forwardly and the incline at the forward portion of the activator cams the lever arm rear protuberance upwardly upon said step for closing said downwardly extending segment of said lever arm upon said forward extension upward bowstring-engaging surface.

3. The mechanism of claim 1, wherein the forward bias upon said activator extension is provided by a coil spring.

4. The mechanism of claim 1, wherein the upward bias upon the lever arm is provided by a coil spring.

5. The mechanism of claim 1, wherein the contact means on said activator extension comprises an enlargement thereof or protuberance thereon.

6. The mechanism of claim 5, wherein the trigger arm is arranged to permit said activator extension to move freely with respect thereto but is adapted to engage the contact means thereon.

7. The mechanism of claim 1, wherein the contact means on said activator extension comprises a ring or washer.

8. The mechanism of claim 1, wherein the contact means on said trigger arm includes a bifurcation of said trigger arm to provide an aperture therein which surrounds said activator extension and is adapted to engage the contact means on said activator extension.

9. The mechanism of claim 1, wherein said forward projection is elongated and generally U-shaped in cross-section.

10. The mechanism of claim 9, wherein said downwardly-extending segment of said lever arm in downward bowstring-retention position rests within or between the upturned edges of said U-shaped forward projection.

11. The mechanism of claim 1, wherein said forward projection is generally U-shaped in cross-section and wherein said U has a flat bottom.

12. The mechanism of claim 10, wherein said downwardly-extending segment of said lever arm in downward bowstring-retention position rests within or between the upturned edges of the said flat-bottomed U.

13. The mechanism of claim 1, wherein said activator extension extends rearwardly outside of said head.

14. The mechanism of claim 1, mounted to a hand wrap or handle.

15. The mechanism of claim 1, wherein said activator, activator extension, and the contact means on said activator extension are integral.

16. The mechanism of claim 15, wherein the forward biasing means comprises a coil spring and a ball bearing and wherein said spring is located in a cavity in said activator extension.

17. The mechanism of claim 1, wherein said activator extension has a rearward cavity for receipt of springbiasing means therein.

18. The mechanism of claim 1, wherein said trigger arm is integral with a trigger comprising a set screw for adjusting the distance between the housing and the trigger and thus the length of the trigger pull.

19. The mechanism of claim 1, wherein the forward biasing means comprises a coil spring and a ball bearing.

20. The mechanism of claim 1, wherein said activator has a cross-sectionally rectangular forward end which fits into a corresponding aperture in said head.

* * * * *

UNITED STATES PATENT AND TRADEMARK OFFICE

CERTIFICATE OF CORRECTION

PATENT NO. : 5,871,004
DATED : Feb. 16, 1999
INVENTOR(S) : Geary Garvison

It is certified that error appears in the above-indentified patent and that said Letters Patent is hereby corrected as shown below:

Title Page, Column 2, [56] References Cited, U.S. Patent Documents, line 2: "5,618,662" should read -- 5,615,662 --.

Column 8, lines 13 and 14: "about pivot point P" should read -- about pivot point PP -- and continue here with line 14.

Signed and Sealed this

Twenty-seventh Day of July, 1999

*Attest:*

Q. TODD DICKINSON

*Attesting Officer*

*Acting Commissioner of Patents and Trademarks*